US010753702B2

(12) United States Patent
Yorns et al.

(10) Patent No.: US 10,753,702 B2
(45) Date of Patent: Aug. 25, 2020

(54) AIR GUN WITH FOLDING HANDLE ASSEMBLY

(71) Applicant: Guardair Corp., Chicopee, MA (US)

(72) Inventors: Mark W. Yorns, Longmeadow, MA (US); Thomas C. Tremblay, Concord, MA (US); Eric A. Mills, Shelburne Falls, MA (US)

(73) Assignee: Guardair Corp., Chicopee, MA (US)

( * ) Notice: Subject to any disclaimer, the term of this patent is extended or adjusted under 35 U.S.C. 154(b) by 112 days.

(21) Appl. No.: 15/884,547

(22) Filed: Jan. 31, 2018

(65) Prior Publication Data

US 2018/0149446 A1 May 31, 2018

Related U.S. Application Data

(63) Continuation of application No. 14/215,674, filed on Mar. 17, 2014, now abandoned.

(60) Provisional application No. 61/792,234, filed on Mar. 15, 2013.

(51) Int. Cl.
*F41B 11/70* (2013.01)

(52) U.S. Cl.
CPC ..... *F41B 11/70* (2013.01); *Y10T 74/2051* (2015.01)

(58) Field of Classification Search
CPC ..... F41B 11/70; Y10T 74/2051; B05B 15/63; B05B 15/62; G05G 1/10; G05G 5/05; B25D 9/08; B25D 17/04; B25C 7/00; B25F 5/00; B25F 5/02; B25F 5/021; B25F 5/025; B25F 5/026
See application file for complete search history.

(56) References Cited

U.S. PATENT DOCUMENTS

| | | | | |
|---|---|---|---|---|
| 2,545,659 | A | 3/1951 | Ginter | |
| 5,236,129 | A | 8/1993 | Grime et al. | |
| 5,725,422 | A * | 3/1998 | Leweck | B24B 23/005 16/426 |
| 5,944,006 | A * | 8/1999 | Moore | F41B 11/642 124/65 |
| 6,241,594 | B1 | 6/2001 | Lepold | |
| 7,191,494 | B2 | 3/2007 | Badiali | |
| 7,530,885 | B2 * | 5/2009 | Sun | B24B 23/026 451/344 |
| 7,712,393 | B2 | 5/2010 | Bertani | |
| 8,122,569 | B2 | 2/2012 | Paul | |
| 2004/0093745 | A1 | 5/2004 | Liao | |
| 2006/0016300 | A1 | 1/2006 | Bubel | |
| 2008/0054104 | A1 | 3/2008 | Tremblay et al. | |
| 2013/0042730 | A1 | 2/2013 | Griffin | |

FOREIGN PATENT DOCUMENTS

| | | | |
|---|---|---|---|
| DE | 10138065 A1 | 2/2003 | |
| EP | 1166972 A2 * | 1/2002 | B25D 17/04 |

OTHER PUBLICATIONS

Machine Translation of DE 10138065, obtained Oct. 31, 2016.

* cited by examiner

*Primary Examiner* — Arthur O. Hall
*Assistant Examiner* — Steven M Cernoch
(74) *Attorney, Agent, or Firm* — Foley Hoag LLP; Rajesh Vallabh

(57) ABSTRACT

Devices and methods for folding handles are disclosed.

13 Claims, 6 Drawing Sheets

AIR GUN WITH FOLDING HANDLE ASSEMBLY

RELATED APPLICATION

This application is a continuation of U.S. patent application Ser. No. 14/215,674 filed on Mar. 17, 2014 entitled LOCKING HANDLE, which claims priority to U.S. Provisional Patent Application 61/792,234, filed on Mar. 15, 2013 entitled LOCKING HANDLE, both of which applications are hereby incorporated by reference.

SUMMARY

Devices and methods for locking handles are disclosed.

DETAILED DESCRIPTION

In many devices it can be useful to have a handle that can either deployed or stowed as the user selects, and it can be particularly useful to have the handle lock in either or both positions. A handle and a body can be attached in such a way that the handle is biased toward a locked position with a locking portion of the handle sized and shaped to be mated with a locking portion of the base. The locking portion of the handle can be complementary to the locking portion of the base. The bias can be achieved by means of a spring. The handle may be lockable in more than one position. For example, the base may have two different locking portions, both of which are complementary to the same locking portion of the handle. The base and handle can be attached in such a way that the locking portion of the handle can be disengaged from a locking portion of the base with out entirely detaching the base and handle. In that disengaged state, the handle can be moved between multiple positions, for example between a deployed position and a stowed position.

Figure 1:
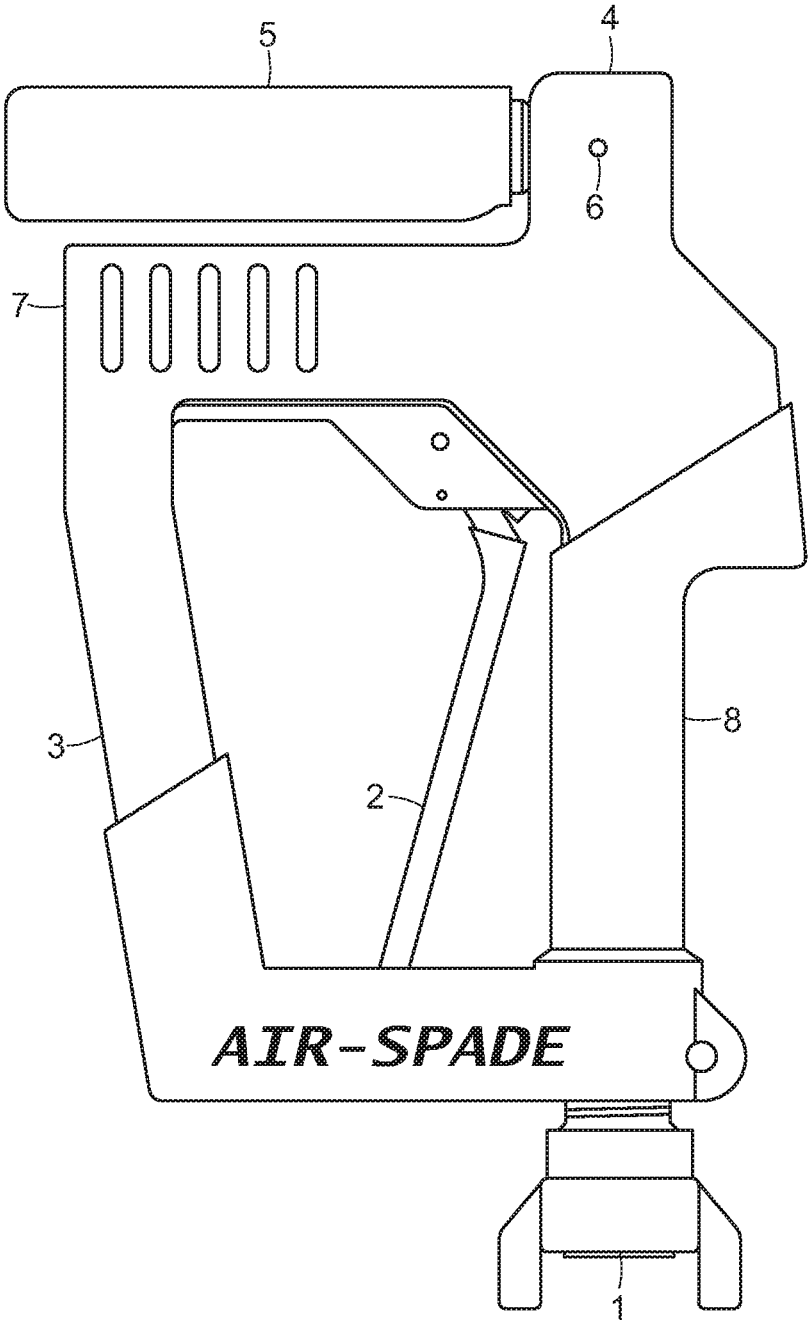
FIG. 1 schematically shows a locking handle assembly configured for use in an air gun.

FIG. 1 schematically shows a locking handle assembly configured for use in an air gun. The assembly includes a supply port 1 where pressurized air is supplied. A trigger 2 can be depressed to create a fluid connection between supply port 1 and exhaust port 7. The trigger is generally surrounded by trigger guard 3. A gudgeon 4 is fixedly attached to the assembly. A folding handle 5 is rotatably attached to the gudgeon 4 by way of a roll pin 6. The static handle 8 is part of the assembly and is fixedly attached without the possibility of rotating relative to the rest of the assembly.

In use with an air gun, the assembly shown in FIG. 1 would have an air supply, e.g., a hose, attached to supply port 1 and an output nozzle attached to exhaust port 7, typically separated from the exhaust port 7 by an elongated shaft. In FIG. 1 this would extend to the left from exhaust port 7. As shown, folding handle 5 is stowed. In this configuration the user can grip static handle 8 to control the air gun. In its extended position, folding handle 5 would be roughly parallel to the static handle, i.e., vertical in FIG. 1. With the folding handle 5 in the extended position, the user could grip the static handle 8 with one hand and the folding handle 5 with the other hand. A user could control the air gun, for example, like a jack-hammer by holding the folding and static handles 5, 8 generally parallel to the ground with the elongated shaft generally vertical and the nozzle pointing toward the ground. Such an assembly could easily be configured for use on any object in which a locking handle would be advantageous, particularly other tools.

Figure 2:
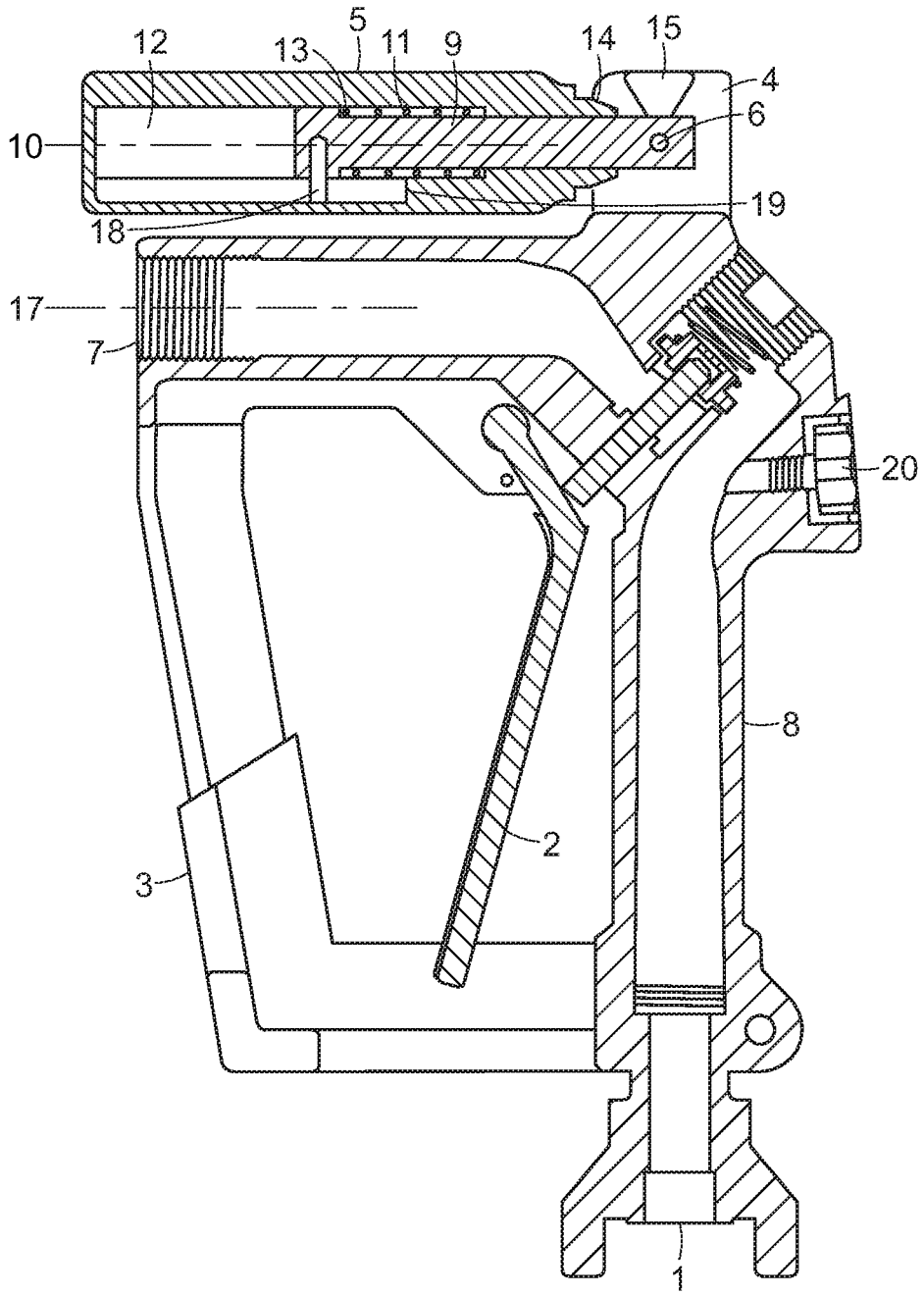
FIG. 2 schematically shows a cross-section of the assembly shown in FIG. 1.
Figure 3:
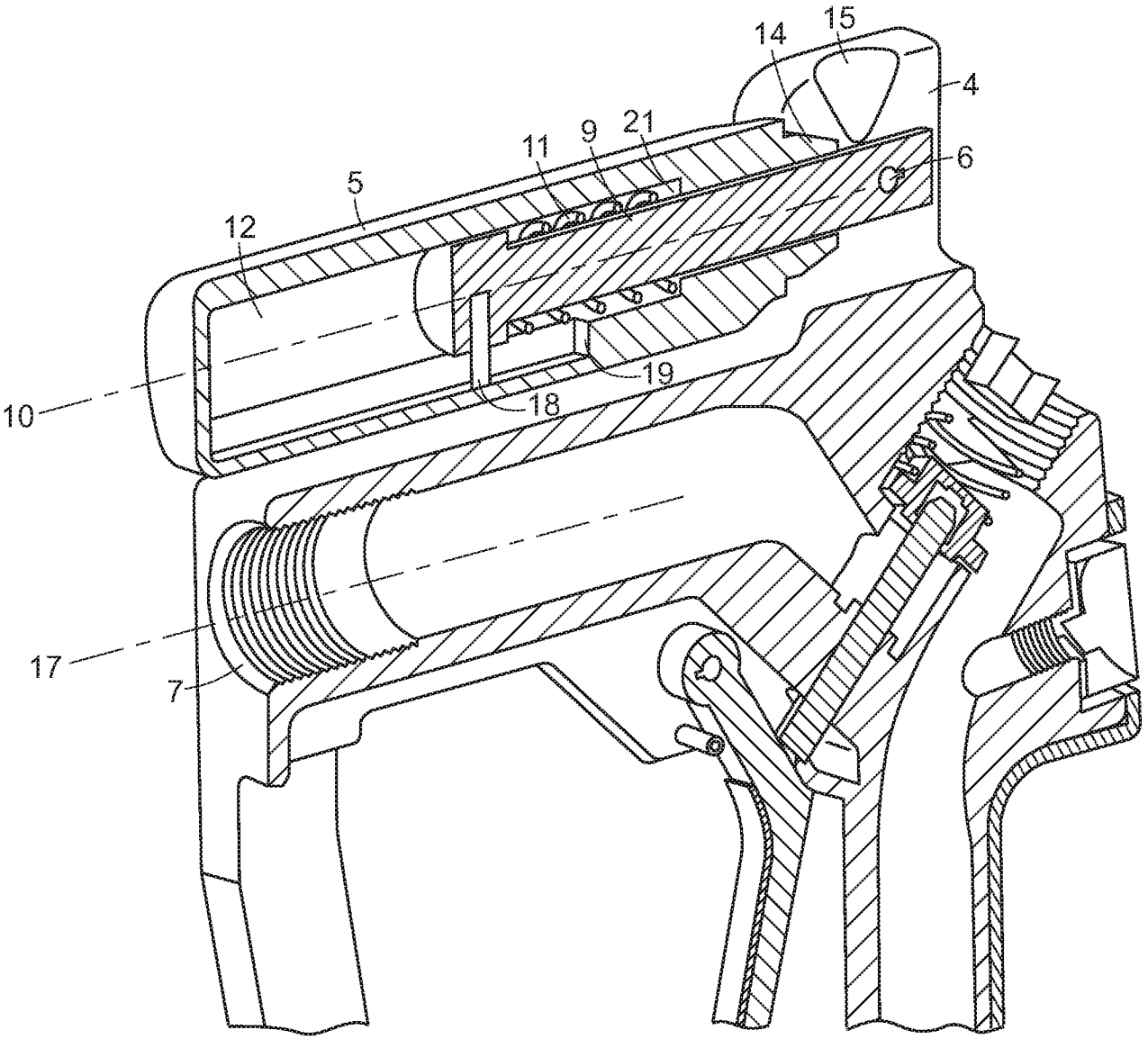
FIG. 3 schematically shows a cross-section of the assembly shown in FIG. 1 is perspective.

FIG. 2 schematically shows a cross-section of the assembly shown in FIG. 1. All elements visible in FIG. 1 are shown in FIG. 2 as well. In cross-section, the interior of the folding handle 5 can be seen. The folding handle 5 defines a blind bore 12 which contains the piston 9 and the spring 11. The piston defines a piston axis 10 that passes through the middle of the piston and also through the roll pin 6. The piston axis 10 is shown as a dashed line in FIGS. 2 and 3. The piston 9 defines a through hole through which the roll pin 6 passes. The roll pin 6 may either be fixedly attached to the gudgeon 4 or may be allowed to rotate with respect to the gudgeon 4, but in any case, the piston 9 and folding handle 5 are allowed to rotate with respect to the gudgeon, at least in certain states. The piston 9 also has a piston ledge 13. The spring 11 surrounds a portion of the piston 9 and one end of spring 11 seats against the piston ledge 13. The other end of the spring 11 seats against a handle ledge 21 (not marked in FIG. 2 because of crowding, but marked and visible in FIG. 3). Because the piston 9 is constrained by the roll pin 6, the piston 9 cannot move along the piston axis 10. The folding handle 5 can translate along the piston axis 10. The effect of the spring 11 is to urge the folding handle 5 along the piston axis 10 toward the roll pin 6 and gudgeon 4.

As shown the roll pin 6 is free to rotate in the gudgeon 4 and also in the folding handle 5. In other embodiments, the roll pin 6 may be either fixedly attached to or an integral part of either the gudgeon 4 or the folding handle 5. But the roll pin 6 may not be fixed with respect to both the gudgeon 4 and the folding handle 5. If it were, then the folding handle 5 would also be fixed with respect to the gudgeon 4. As shown the gudgeon 4 is integrally formed with the main body of the assembly, but could alternatively be a separate part fixedly attached.

The folding handle 5 is not entirely unconstrained. The piston 9 includes a guiding pin 18 that rides in an elongated guiding groove 19 defined by the folding handle 5. The guiding groove 19 does not extend the full length of the blind bore 12. When a user pulls the folding handle 5 away from the gudgeon 4 along the piston axis 10, eventually the folding handle 5 can hit a stop. The stop may be due to contact between the guiding pin 18 and the end of the guiding groove 19. This limits the possible excursion of the folding handle 5 along the piston axis 10. Or the excursion may simply be limited by the compressibility of the spring 11. The primary (although not the only) function of the guiding pin 18 and guiding groove 19 is to prevent the folding handle 5 from rotating about the piston axis 10. In some embodiments, the folding handle 5 can be free to rotate about the piston axis 10. As shown, the folding handle 5 has a roughly trapezoidal profile. If the folding handle 5 had, for example, a circular cross-sectional profile, rotation about the piston axis 10 would not be undesirable.

Figure 4:
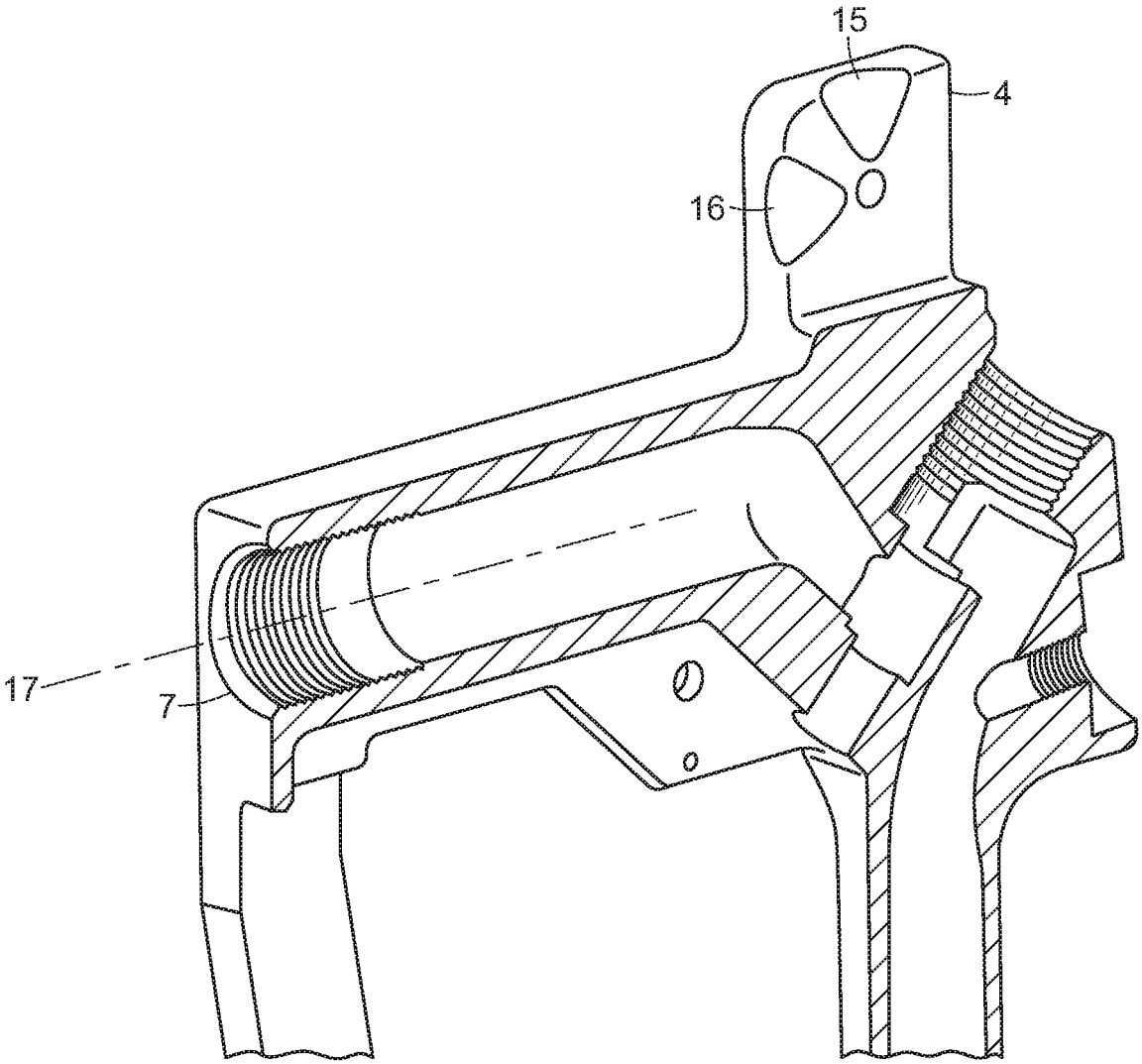
FIG. 4 schematically shows the same cross-section shown in FIG. 3, but including only one part.

At the end near the gudgeon 4, the folding handle 5 has a chamfered end 14. The gudgeon 4 defines two divots 15, 16. Each divot is sized and shaped to match the chamfered end 14. The first divot 15 is visible in FIGS. 2 and 3 because it is empty. The second divot 16 is not visible because it is filled by the chamfered end 14. FIG. 4 schematically shows the same cross-section shown in FIG. 3, but including only the main body of the assembly without the folding handle 5, and so in FIG. 4 both divots 15, 16 are visible since neither is filled by the chamfered end.

With the chamfered end 14 fully seated in the second divot 16, the folding handle 5 is in a locked state and is not free to rotate about the roll pin 6. To transition the folding handle 5 to an unlocked state, the user pulls the folding handle 5 along the piston axis 10 until the chamfered end 14 is clear of the second divot 16. In order to pull the folding handle 5 clear of the second divot 16, the user must compress the spring 11, which normally urges the folding handle 5 in the locked position. Once pulled clear, the folding handle 5 is then free to rotate about the roll pin 6. The folding handle 5, the piston 9 and the spring 11 rotate as a single unit about the roll pin 6.

The folding handle 5, once in the unlocked state, can be rotated so that the chamfered end 14 is above the first divot 15. The folding handle 5 can then be released so that the spring 11 urges the chamfered end 14 into the first divot 15. This transitions the folding handle 5 back into a locked state, this time locked in the first divot 15 rather than the second divot 16. When locked into the first divot 15 the folding handle 5 is generally parallel to the static handle 8.

Although the folding handle 5 is shown with a chamfered end 14 and the gudgeon 4 is shown with conical divots 15, 16 a wide variety of mating shapes could suffice. A cylindrical end could mate with a generally cylindrical bore in the gudgeon 4. Or any other pair of mating, locking shapes could be used.

The exhaust port 7 is the mouth of an air channel inside the assembly. When an elongated air-gun shaft is affixed to the exhaust port 7, the elongated shaft can be generally aligned with longitudinal axis 17 shown as a dashed line in FIGS. 2, 3 and 4. As shown, the folding handle 5 has two different locked states. When the folding handle 5 is locked in the first divot 15, the piston axis 10 and longitudinal axis 17 are generally perpendicular, while the folding handle 5 is generally parallel to the static handle 8 so that the assembly is ready to be held like a jackhammer. When the folding handle 5 is locked in the second divot 16, the piston axis 10 and the longitudinal axis 17 are generally parallel and the folding handle 5 is stowed.

One feature of the depicted assembly is the type of motion necessary to transition the folding handle 5 from the state of being locked in the first divot 15 to the unlocked state. When air is expelled through the exhaust port 7, for example into and then through and out of an elongated shaft of an air gun aligned with the longitudinal axis 17, the recoil on the assembly will tend to be along the longitudinal axis 17. When the folding handle is locked in the first divot 15, the piston axis 10 is perpendicular to the longitudinal axis 17. So the recoil on the assembly will tend to push on the folding handle 5 perpendicular to the only direction it is allowed to move, namely along the piston axis 10. Conversely, the folding handle 5 cannot be unlocked by the recoil, since to unlock the folding handle 5 it must be moved along the piston axis 10, which has no or essentially no component along the longitudinal axis 17.

In the depicted embodiment, the folding handle 5 rotates in only one sense, about the axis of the roll pin 6. But in other embodiments, a different sort of pivot could be used to allow the handle to rotate in more than one sense, for example a ball and socket. Likewise, the folding handle could lock in more than two positions, for example, three, or four, or more. The locked positions could be separated by 90 degrees as shown, 180 degrees, 60 degrees, 45 degrees, 30 degrees, or any other angle, for example an angle that proves convenient or otherwise ergonomic for a user's grip on the device.

As shown, the assembly includes a pressure gauge 20 located so as to be clearly visible to a user who is gripping the air gun as if it were a jackhammer.

Figure 5:
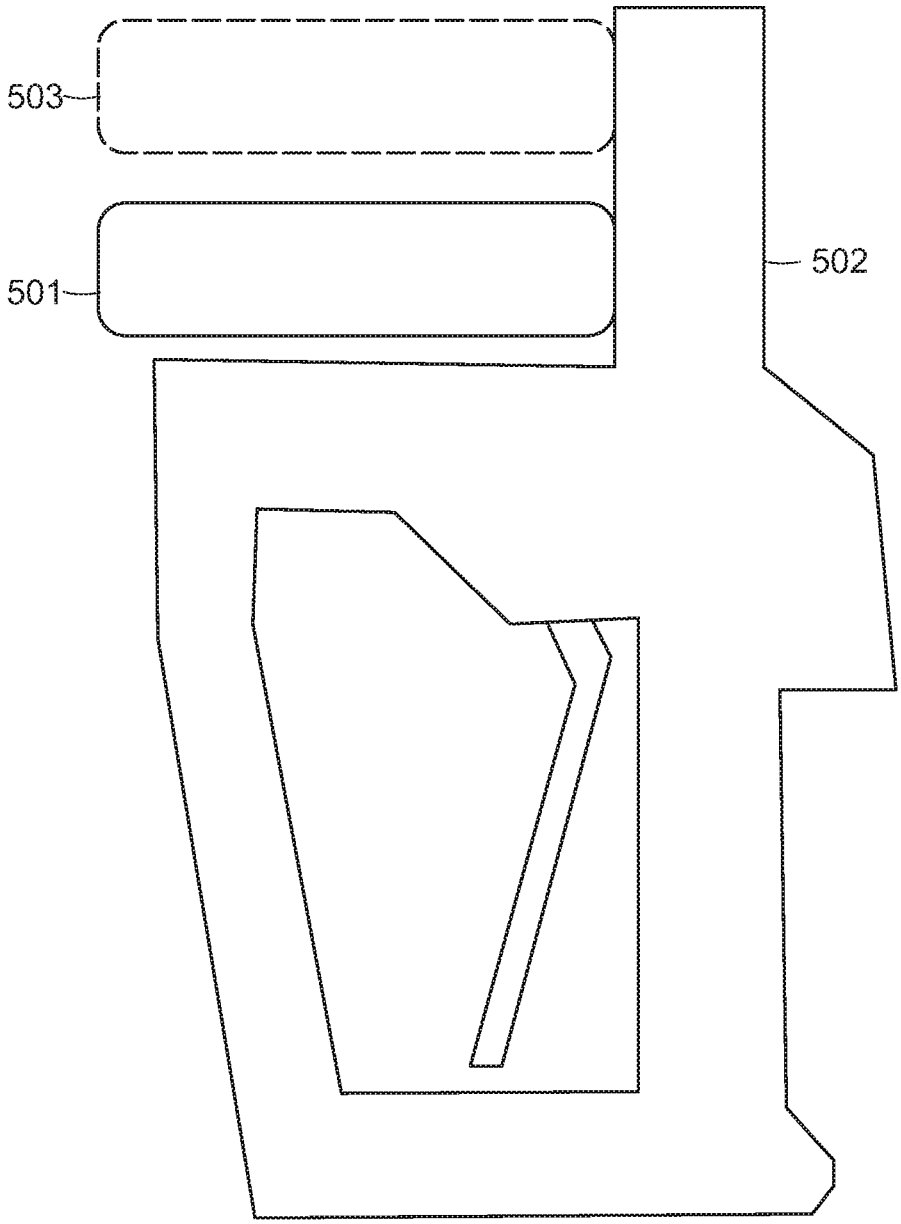
FIG. 5 schematically shows a different locking handle assembly for use in an air gun.

As an alternative to the particular example shown in the figures, the handle could move from stowed to deployed, not by rotating relative to the assembly, but by translating. For example, as shown in FIG. 5, the handle 501 could be slidably mounted relative to the body 502 so that the handle 501 could be put in either a stowed position as shown, or in a deployed position 503 (shown in a dashed line). The handle 501 could, similar to other embodiments, include a chamfered end that seats in one of two divots. The handle could be biased toward seating its chamfered end in the divots by means of an internal spring and piston. In this embodiment, the user pulls the handle 501 away from the body 502 so that the chamfered end clears the divot, thus compressing an internal spring, similar to the embodiment shown in FIGS. 1-4. Then the user slides, rather than rotates, the handle 501 into a deployed position, where the user then releases the handle so that the spring pushes the chamfered end into a different divot. The assembly may include more than two divots, so that the handle can be locked in two, three, four or more different positions.

Figure 6:
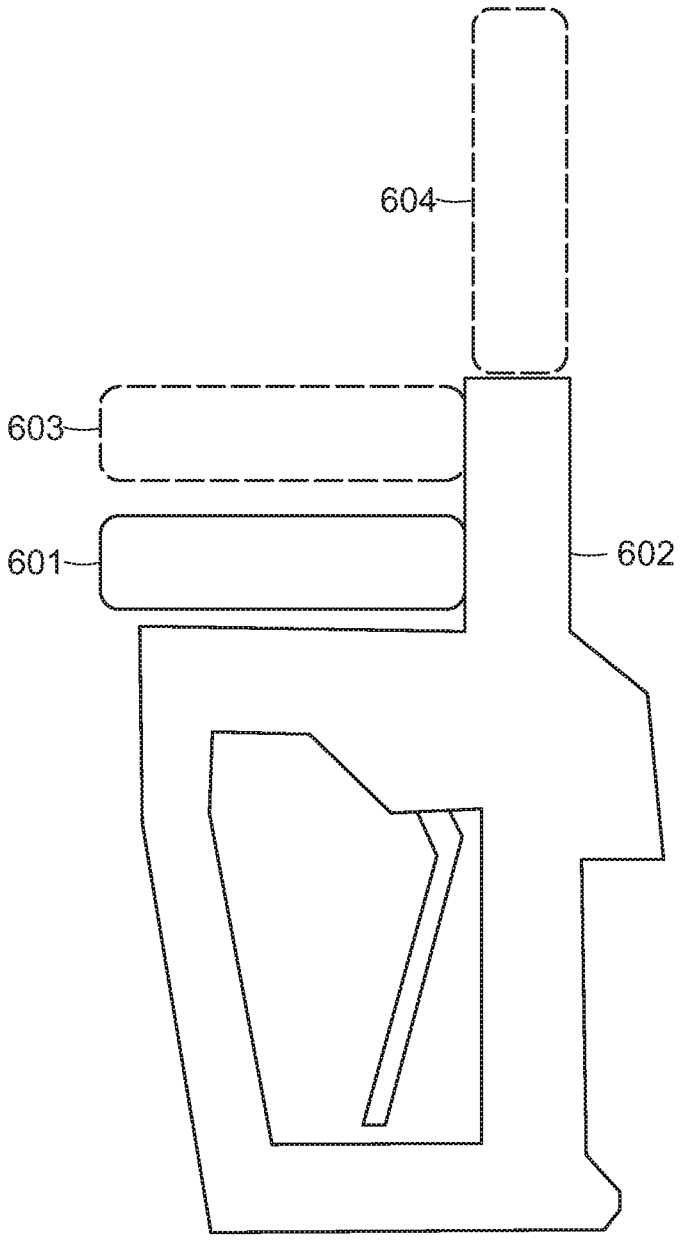
FIG. 6 schematically shows yet another locking handle assembly for use in an air gun.

In some embodiments, the handle can be both slidable and rotatable. For example, as shown in FIG. 6, similar to the embodiment in FIG. 5, the handle 601 can be disengaged from the base 602 and slid into a first deployed position 603. In addition, the handle can then be rotated, similar to the handle on the embodiment shown in FIGS. 1-4, to a second deployed position 604.

A locking handle assembly can include a gudgeon, a roll pin, a piston defining a piston axis, a spring, and a handle. The roll pin can be operably attached to the gudgeon so that the roll pin cannot translate relative to the gudgeon. The piston can be operably attached to the roll pin so that the piston can rotate about the roll pin but cannot otherwise translate relative to the roll pin or the gudgeon. The handle can define a blind bore substantially aligned with the piston axis. The spring and a portion of the piston can be arranged within the blind bore so that the spring biases the handle relative to the piston toward the gudgeon along the piston axis. The handle can be configured to transition between a first locked state and an unlocked state by translating relative to the piston along the piston axis. When the handle is in the first locked state, (a) a chamfered end of the handle can be held in contact with a first divot, the first divot being defined by the gudgeon and being sized and shaped to mate with the chamfered end, and (b) the chamfered end can be held in contact with the first divot by the bias of the spring acting along the piston axis such that interference of the chamfered end with the first divot substantially prevents the handle, the piston and the spring from rotating relative to the gudgeon. When the handle is in the unlocked state, (a) the handle can be farther from the gudgeon along the piston axis than in the locked state so that the chamfered end of the handle is clear of the first divot, thereby allowing the handle, the piston and the spring to rotate relative to the gudgeon, (b) the handle can be urged along the piston axis by the bias of the spring, and (c) the spring can be more compressed along the piston axis in the unlocked state than in the locked state.

In such assemblies, the gudgeon can further define a second divot sized and shaped to mate with the chamfered end, the handle can be further configured to transition between the unlocked state and a second locked state by translating relative to the piston axis, when the handle is in the second locked state, (a) the chamfered end of the handle can be held in contact with the second divot, and (b) the chamfered end can be held in contact with the second divot by the bias of the spring acting along the piston axis such that interference of the chamfered end with the second divot substantially prevents the handle, the piston and the spring from rotating relative to the gudgeon, and the first and second divots can be spaced apart on the gudgeon so that in the first locked state the handle assumes a first orientation relative to the gudgeon and in the second locked state the handle assumes a second orientation relative to the gudgeon. In the first orientation the piston axis can be rotated 90 degrees about the roll pin relative to the second orientation of the piston axis.

An air gun can include such a locking handle assembly and an elongated shaft defining a longitudinal axis. The elongated shaft can include a user end configured to be supplied with pressurized air, and a working end configured to discharge pressurized air, the shaft can define a channel substantially aligned with the longitudinal axis, the user end can be in fluid communication with the working end through the channel, the gudgeon can be fixedly attached to the elongated shaft adjacent to the user end such that the gudgeon can neither rotate nor translate relative to the elongated shaft, the piston axis in the first orientation can be substantially perpendicular to the longitudinal axis, and the piston axis in the second orientation can be substantially parallel to the longitudinal axis.

In some embodiments, a locking handle assembly can include a base, a locking handle operably attached to the base, and a means for disposing the handle relative to the base so that the handle either (a) cannot translate relative to the base in at least a first position and a second position relative to the base, or (b) can transition between the first and second positions. The means for disposing the handle can, for example, include the roll-pin-and-gudgeon-type assembly shown in FIGS. 1-4, or an assembly in which the handle translates relative to the base as shown in FIGS. 5 and 6, or any other type of assembly in which the handle can be in (a) a locked state in any of two or more locked positions, or (b) a transition state in which the handle can move between the various locked states.

The invention claimed is:

1. An air gun, comprising:

a gun body including an inlet port configured to be coupled to a source of pressurized air for receiving the pressurized air, an outlet port for discharging the pressurized air out of the air gun, and an air passage connecting the inlet port and the outlet port, said air passage being located between the inlet port and the outlet port, said gun body also defining a first handle configured to be held by a first hand of a user;

a valve assembly in the gun body for controlling flow of air from the inlet port to the outlet port;

a trigger assembly operably connected to the valve assembly, said trigger assembly including a trigger configured to be operated by the first hand of the user while holding the first handle; and a folding handle assembly connected to the gun body, said folding handle assembly including a second handle movable between a first releasably locked position and a second releasably locked position, wherein in the first releasably locked position, the second handle is flush with the gun body and the air gun is in a one-handed operation mode, and wherein in the second releasably locked position, the second handle is moved relative to the gun body such that the second handle can be held by a second hand of the user and the air gun is in a two-handed operation mode; and wherein the first and second handles are substantially perpendicular in the first releasably locked position; and wherein the first and second handles are substantially aligned to each other in the second releasably locked position, wherein the first and second handles extend substantially alone the same line on opposite sides of the air gun.

2. The air gun of claim 1, wherein the folding handle assembly is connected to the gun body by a roll pin such that the second handle is pivotable relative to the gun body between the first releasably locked position and the second releasably locked position.

3. The air gun of claim 1, wherein the folding handle assembly includes a piston rotatably connected to the gun body by a roll pin, said piston slidingly mounted in a bore in the second handle, wherein the folding handle assembly further includes a spring in the bore engaging the piston for biasing the second handle toward the roll pin, wherein the second handle can be pulled by a user away from the roll pin to enable movement of the second handle from the first releasably locked position to the second releasably locked position.

4. The air gun of claim 3, wherein at least a portion of the second handle configured to be gripped by the user is inhibited from rotating about a central axis of the bore.

5. The air gun of claim 3, wherein the second handle includes a chamfered end, and wherein the air gun includes a gudgeon holding the roll pin, said gudgeon including a first divot configured to engage the chamfered end of the second handle when the second handle is in the first releasably locked position, wherein the gudgeon also includes a second divot configured to engage the chamfered end of the second handle when the second handle is in the second releasably locked position, wherein the spring urges the chamfered end of the second handle against the first and second divots in the first and second releasably locked positions, respectively, and wherein the chamfered end of the second handle can be disengaged from the divots by pulling the second handle away from the roll pin to enable the second handle to be moved between the first and second releasably locked positions.

6. The air gun of claim 1, further comprising means for locking the second handle in one or more additional intermediate positions between the first and second releasably locked positions.

7. The air gun of claim 1, wherein the portion of the air passage proximate the outlet port is substantially parallel to the second handle when the second handle is in the first releasably locked position and substantially perpendicular to the first and second handles when the second handle is in the second releasably locked position.

8. The air gun of claim 1, wherein the first handle surrounds a portion of the air passage proximate the inlet port.

9. The air gun of claim 1, wherein the second handle is moved from the first releasably locked position to the second releasably locked position by both translating and rotating the second handle relative to the gun body.

10. An air gun, comprising:

a gun body including an inlet port for receiving pressurized air, said inlet port including means for attachment to a source of the pressurized air, an outlet port for discharging the pressurized airout of the airgun, and an air passage connecting the inlet port and the outlet port, said air passage being located between the inlet port and the outlet port, said gun body also defining a first handle surrounding a portion of the air passage and configured to be held by a first hand of a user;

a valve assembly in the gun body for controlling flow of air from the inlet port to the outlet port;

a trigger assembly operably connected to the valve assembly, said trigger assembly including a trigger configured to be operated by the first hand of the user while holding the first handle; and a folding handle assembly connected to the gun body, said folding handle assembly including a second handle and means for releasably locking the second handle in either a first releasably locked position or a second releasably locked position, wherein in the first releasably locked position, the second handle is flush with the gun body and the air gun is in a one-handed operation mode, and wherein in the second releasably locked position the air gun is in a two-handed operation mode wherein the second handle is moved relative to the gun body such that the second handle can be held by a second hand of the user while the first handle is held by the first hand of the user and the trigger assembly is operated by the first hand of the user; and wherein the first and second handles are substantially perpendicular in the first releasably locked position; and wherein the first and second handles are substantially aligned to each other in the second releasably locked position, wherein the first and second handles extend substantially on the same line on opposite sides of the air gun.

11. The air gun of claim 10, wherein the means for releasably locking the second handle includes a piston rotatably connected to the gun body by a roll pin, said piston slidingly mounted in a bore in the second handle, wherein the means further includes a spring in the bore engaging the piston for biasing the second handle toward the roll pin, wherein the second handle can be pulled by a user away from the roll pin to enable movement of the second handle from the first releasably locked position to the second releasably locked position.

12. The air gun of claim 11, wherein at least a portion of the second handle configured to be gripped by the user is inhibited from rotating about a central axis of the bore.

13. The air gun of claim 11, wherein the second handle includes a chamfered end, and wherein the air gun includes a gudgeon holding the roll pin, said gudgeon including a first divot configured to engage the chamfered end of the second handle when the second handle is in the first releasably locked position, wherein the gudgeon also includes a second divot configured to engage the chamfered end of the second handle when the second handle is in the second releasably locked position, wherein the spring urges the chamfered end of the second handle against the first and second divots in the first and second releasably locked positions, respectively, and wherein the chamfered end of the second handle can be disengaged from the divots by pulling the second handle away from the roll pin to enable the second handle to be moved between the first and second releasably locked positions.

* * * * *